US008516973B1

(12) United States Patent
Hamilton

(10) Patent No.: US 8,516,973 B1
(45) Date of Patent: Aug. 27, 2013

(54) MOTOR POWERED KAYAK SYSTEM

(76) Inventor: Robert D. Hamilton, Palm Harbor, FL (US)

( * ) Notice: Subject to any disclaimer, the term of this patent is extended or adjusted under 35 U.S.C. 154(b) by 42 days.

(21) Appl. No.: 13/066,606

(22) Filed: Apr. 19, 2011

(51) Int. Cl.
*B63B 17/00* (2006.01)
*B63B 35/00* (2006.01)
*F16M 1/00* (2006.01)

(52) U.S. Cl.
USPC ..... 114/347; 114/364; 248/640

(58) Field of Classification Search
USPC ..... 440/49; 114/347, 364; 248/640, 248/641, 643
See application file for complete search history.

(56) References Cited

U.S. PATENT DOCUMENTS

| | | | | | |
|---|---|---|---|---|---|
| 1,118,208 | A * | 11/1914 | McLaren | 248/641 |
| 3,075,490 | A * | 1/1963 | Lang | 440/53 |
| 4,616,591 | A * | 10/1986 | Minor | 114/347 |
| 5,499,792 | A * | 3/1996 | Tamiso | 248/643 |
| 5,941,742 | A * | 8/1999 | Whitaker | 440/1 |
| 6,530,170 | B1 * | 3/2003 | Sweeney | 43/21.2 |
| 2010/0012814 | A1 * | 1/2010 | Boebel | 248/640 |

* cited by examiner

*Primary Examiner* — Stephen Avila

(57) ABSTRACT

A support assembly has upper, lower and top-most plates. The upper and lower plates each have interior and exterior ends. The plates each have upper and lower surfaces and a plurality of upper, lower and top-most plate holes. Left and right fingers extend downwardly from the upper and lower plates at an angle from the vertical. Two laterally spaced pole-holding tubes are secured to and extend upwardly from the top-most plate. Each tube has an upper end with a short vertical slot for receiving a reel of a fishing rod. A motor mounting board is positioned on and extends upwardly from the upper surface of the lower plate adjacent to the exterior end.

1 Claim, 2 Drawing Sheets

MOTOR POWERED KAYAK SYSTEM

BACKGROUND OF THE INVENTION

1. Field of the Invention

The present invention relates to a motor powered kayak system and more particularly pertains to removably coupling a motor to a kayak and for securely retaining the motor on the kayak during use, the coupling and retaining being done in a safe, economic and reliable manner.

2. Summary of the Invention

In view of the disadvantages inherent in the known types of kayak systems of known designs and configurations now present in the prior art, the present invention provides an improved motor powered kayak system. As such, the general purpose of the present invention, which will be described subsequently in greater detail, is to provide a new and improved motor powered kayak system and method which has all the advantages of the prior art and none of the disadvantages.

To attain this, the present invention essentially comprises a motor powered kayak system. First provided is a kayak. The kayak has a front. The kayak has a rear. A length is defined between the front and rear. The kayak has a transverse intermediate region. The intermediate region is provided between the front and the rear. The kayak has a top. The kayak has a bottom. A height is defined between the top and bottom. The kayak has a left side. The kayak has a right side. A width is defined between the left side and the right side. The kayak has a vertically oriented, longitudinal center plane. The central plane extends between the front and the back midway between the left side and the right side.

The kayak has a pair of cylindrical recesses. The recesses are formed into the intermediate region. The recesses include a left recess. The recess also include a right recess. The recesses have upper ends in the top at the left and right sides. The recesses extend downwardly towards each other into the kayak at an angle of between 25 and 35 degrees. The recesses terminate at lower ends. The recesses are in a vertical transverse plane. The lower ends are provided closer to the center plane than the upper ends.

A support assembly is provided. The support assembly has an upper plate. The support assembly has a lower plate. The plates each have an interior end. The plates each have an exterior end. The plates each have an upper surface. The plates each have a lower surface. The upper plate has a plurality of upper plate holes. The upper plate holes extend vertically through the upper plate. The lower plate has a plurality of lower plate holes. The lower plate has a slot. The lower plate holes and slot extend vertically through the lower plate. In this manner extending and contracting the spacing of the plates is facilitated.

A left mount is provided next. The left mount extends downwardly from the upper plate adjacent to the exterior end. An eye bolt is provided. The eye bolt extends through the upper plate. The eye bolt is threadedly received through the left mount. The left mount is provided at an angle of between 25 degrees and 35 degrees from the vertical. The left mount is removably received in the left recess. A similarly configured right mount is provided. The right mount extends downwardly from the lower plate adjacent to an intermediate extent of the lower plate. An eye bolt is provided. The eye bolt is provided through the lower plate. The eye bolt is threadedly received through the right mount. The right mount is provided at an angle from the vertical. The right mount is removably received in the right recess. An upper most short plate is provided. The upper most short plate has two laterally spaced short plate holes. Two bolts are provided. The bolts extend vertically through holes through the interior ends of the lower and upper plates and the top-most plate. Wing nuts are provided. The wing nuts are coupled to the bolts. In this manner the lower, upper and top-most plates are secured together.

Provided next are two laterally spaced pole-holding tubes. The tubes are secured to and extend upwardly from the top-most plate. Each tube is adapted to receive a fishing rod. Each tube has an upper end. The upper end of each tube has a short vertical slot. In this manner the reel of a fishing rod is received.

Further provided is a vertically oriented motor mounting board. The motor mounting board has vertical holes. The vertical holes are positioned on the upper surface of the lower plate adjacent to the exterior end. Carriage bolts are provided. The carriage bolts extend downwardly through the holes of the mounting board. The carriage bolts further extend through the lower plate adjacent to the exterior end. Washer and locking nuts are provided. The washer and locking nuts threadedly receive the carriage bolts for removable securement purposes.

Provided last is a motor. The motor is removably received on the mounting board. The motor extends downwardly from one side of the kayak into water. In this manner the kayak is supported.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved motor powered kayak system which has all of the advantages of the prior art kayak systems of known designs and configurations and none of the disadvantages.

It is another object of the present invention to provide a new and improved motor powered kayak system which may be easily and efficiently manufactured and marketed.

It is further object of the present invention to provide a new and improved motor powered kayak system which is of durable and reliable constructions.

An even further object of the present invention is to provide a new and improved motor powered kayak system which is susceptible of a low cost of manufacture with regard to both materials and labor, and which accordingly is then susceptible of low prices of sale to the consuming public, thereby making such motor powered kayak system economically available to the buying public.

Even still another object of the present invention is to provide a motor powered kayak system for removably coupling a motor to a kayak and for securely retaining the motor on the kayak during use, the coupling and retaining being done in a safe, economic and reliable manner.

Lastly, it is an object of the present invention to provide a new and improved motor powered kayak system. A support assembly has upper, lower and top-most plates. The upper and lower plates each have interior and exterior ends. The plates each have upper and lower surfaces and a plurality of upper, lower and top-most plate holes. Left and right fingers extend downwardly from the upper and lower plates at an angle from the vertical. Two laterally spaced pole-holding tubes are secured to and extend upwardly from the top-most plate. Each tube has an upper end with a short vertical slot for receiving a reel of a fishing rod. A motor mounting board is positioned on and extends upwardly from the upper surface of the lower plate adjacent to the exterior end.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figures 1, 3:
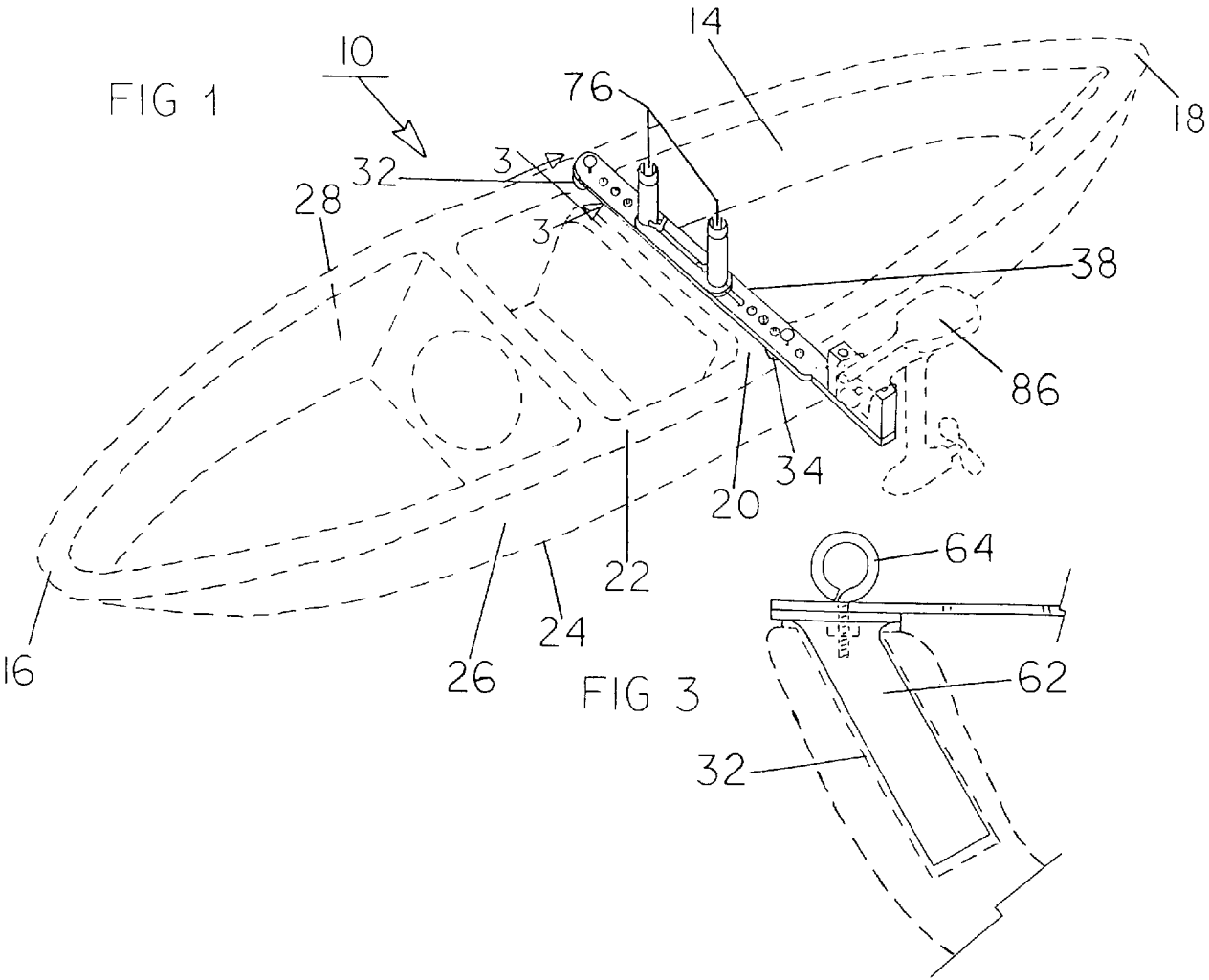
FIG. 1 is a perspective illustration of a motor powered kayak system constructed in accordance with the principles of the present invention.
FIG. 3 is a front elevational view of a portion of the system taken along line 3-3 of FIG. 1.
Figure 2:
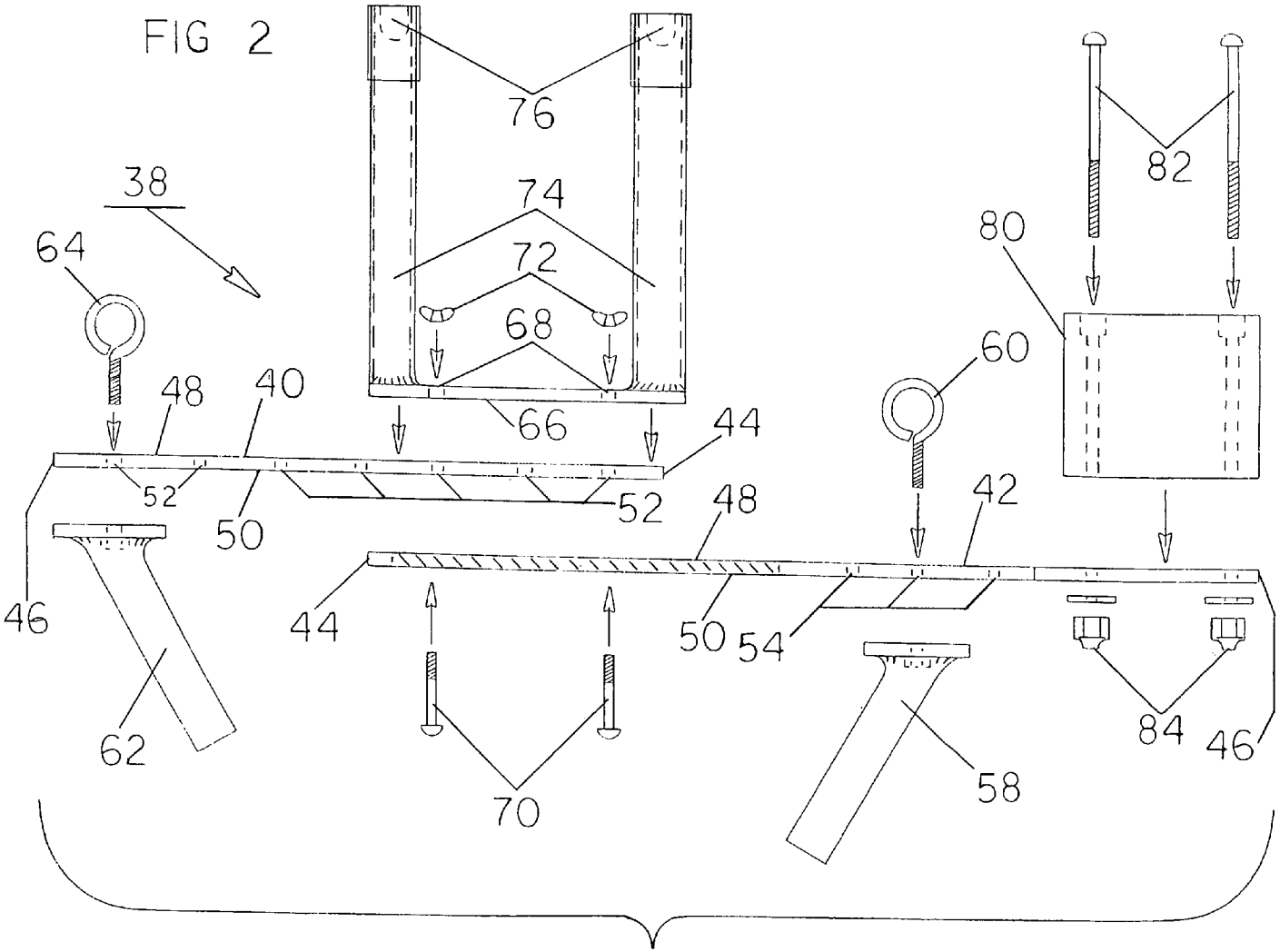
FIG. 2 is an exploded front elevational view of the support assembly illustrated in FIG. 1.

With reference now to the drawings, and in particular to FIG. 1 thereof, the preferred embodiment of the new and improved motor powered kayak system embodying the principles and concepts of the present invention and generally designated by the reference numeral 10 will be described.

The present invention, the motor powered kayak system 10 is comprised of a plurality of components. Such components in their broadest context include a support assembly, left and right fingers, two laterally spaced pole-holding tubes and a motor mounting board. Such components are individually configured and correlated with respect to each other so as to attain the desired objective.

First provided is a kayak 14. The kayak has a front 16. The kayak has a rear 18. A length is defined between the front and rear. The kayak has a transverse intermediate region 20. The intermediate region is provided between the front and the rear. The kayak has a top 22. The kayak has a bottom 24. A height is defined between the top and bottom. The kayak has a left side 26. The kayak has a right side 28. A width is defined between the left side and the right side. The kayak has a vertically oriented, longitudinal center plane. The central plane extends between the front and the back midway between the left side and the right side.

The kayak has a pair of cylindrical recesses. The recesses are formed into the intermediate region. The recesses include a left recess 32. The recess also include a right recess 34. The recesses have upper ends in the top at the left and right sides. The recesses extend downwardly towards each other into the kayak at an angle of between 25 and 35 degrees. The recesses terminate at lower ends. The recesses are in a vertical transverse plane. The lower ends are provided closer to the center plane than the upper ends.

A support assembly 38 is provided. The support assembly has an upper plate 40. The support assembly has a lower plate 42. The plates each have an interior end 44. The plates each have an exterior end 46. The plates each have an upper surface 48. The plates each have a lower surface 50. The upper plate has a plurality of upper plate holes 52. The upper plate holes extend vertically through the upper plate. The lower plate has a plurality of lower plate holes 54. The lower plate has a slot 56. The lower plate holes and slot extend vertically through the lower plate. In this manner extending and contracting the spacing of the plates is facilitated.

A left mount 58 is provided next. The left mount extends downwardly from the upper plate adjacent to the exterior end. An eye bolt 60 is provided. The eye bolt extends through the upper plate. The eye bolt is threadedly received through the left mount. The left mount is provided at an angle of between 25 degrees and 35 degrees from the vertical. The left mount is removably received in the left recess. A similarly configured right mount 62 is provided. The right mount extends downwardly from the lower plate adjacent to an intermediate extent of the lower plate. An eye bolt 64 is provided. The eye bolt is provided through the lower plate. The eye bolt is threadedly received through the right mount. The right mount is provided at an angle from the vertical. The right mount is removably received in the right recess. An upper most short plate 66 is provided. The upper most short plate has two laterally spaced short plate holes 68. Two bolts 70 are provided. The bolts extend vertically through holes through the interior ends of the lower and upper plates and the top-most plate. Wing nuts 72 are provided. The wing nuts are coupled to the bolts. In this manner the lower, upper and top-most plates are secured together.

Provided next are two laterally spaced pole-holding tubes 74. The tubes are secured to and extend upwardly from the top-most plate. Each tube is adapted to receive a fishing rod. Each tube has an upper end. The upper end of each tube has a short vertical slot 76. In this manner the reel of a fishing rod is received. A greater or lesser number of pole-holding tubes could readily be utilized.

Further provided is a vertically oriented motor mounting board 80. The motor mounting board has vertical holes. The vertical holes are positioned on the upper surface of the lower plate adjacent to the exterior end. Carriage bolts 82 are provided. The carriage bolts extend downwardly through the holes of the mounting board. The carriage bolts further extend through the lower plate adjacent to the exterior end. Washer and locking nuts are provided. The washer and locking nuts threadedly receive the carriage bolts for removable securement purposes.

Provided last is a motor 86. The motor is removably received on the mounting board. The motor extends downwardly from one side of the kayak into water. In this manner the kayak is supported.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A motor powered kayak system (10) for removably coupling a motor to a kayak and for securely retaining the motor on the kayak during use, the coupling and retaining being done in a safe, convenient and economical manner, the system comprising, in combination:

a kayak (14) having a front (16) and a rear (18) defining a length there between, the kayak having a transverse intermediate region (20) between the front and the rear, the kayak having a top (22) and a bottom (24) defining a height there between, the kayak having a left side (26) and a right side (28) defining a width there between, the kayak having a vertically oriented, longitudinal center plane extending between the front and the back midway between the left side and the right side;

a pair of cylindrical recesses including a left recess (32) and a right recess (34), the recesses being similarly configured and formed into the kayak at the intermediate region, the recesses having upper ends in the top at the left and right sides, the recesses extending downwardly towards each other into the kayak at an angle of between 25 and 35 degrees and terminating at lower ends, the recesses being in a vertical transverse plane with the lower ends being closer to the center plane than the upper ends;

a support assembly (38) having an upper plate (40) and a lower plate (42), the plates each having an interior end (44) and an exterior end (46), the plates each having an upper surface (48) and a lower surface (50), a plurality of upper plate holes (52) extending vertically through the upper plate, a plurality of lower plate holes (54) and slot (56) extending vertically through the lower plate, the holes in the upper and lower plates facilitating the extending and contracting the spacing of the plates;

a left mount (58) extending downwardly from the upper plate adjacent to the exterior end, an eye bolt (60) through the upper plate and threadedly received through the left mount, the left mount being at an angle of between 25 degrees and 35 degrees from the vertical and removably received in the left recess, a similarly configured right mount (62) extending downwardly from the lower plate adjacent to an intermediate extent of the lower plate, an eye bolt (64) through the lower plate and threadedly received through the right mount, the right mount being at an angle from the vertical and removably received in the right recess, an upper most short plate (66) with two laterally spaced short plate holes (68), two bolts (70) extending vertically through holes through the interior ends of the lower and upper plates and the top-most plate with wing nuts (72) coupled to the bolts securing together the lower and upper and top-most plates;

two laterally spaced pole-holding tubes (74) secured to and extending upwardly from the top-most plate, each tube adapted to receive a fishing rod, each tube having an upper end with a short vertical slot (76) for receiving a reel of a fishing rod;

a vertically oriented motor mounting board (80) with vertical holes positioned on the upper surface of the lower plate adjacent to the exterior end, carriage bolts (82) extending downwardly through the holes of the mounting board and through the lower plate adjacent to the exterior end, washer and locking nuts threadedly receiving the carriage bolts for removable securement purposes; and a motor (86) removably received on the mounting board and extending downwardly from one side of the kayak into water supporting the kayak.

* * * * *